US006597252B1

(12) United States Patent
Okada et al.

(10) Patent No.: US 6,597,252 B1
(45) Date of Patent: Jul. 22, 2003

(54) NONRECIPROCAL CIRCUIT DEVICE WITH SERIES AND PARALLEL MATCHING CAPACITORS AT DIFFERENT PORTS

(75) Inventors: Takekazu Okada, Ishikawa-ken (JP); Shinichiro Ichiguchi, Kanazawa (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 09/636,020

(22) Filed: Aug. 10, 2000

(30) Foreign Application Priority Data

Aug. 10, 1999 (JP) ..... 11-226459

(51) Int. Cl.[7] ..... H01P 1/383; H01P 1/36
(52) U.S. Cl. ..... 333/1.1; 333/24.2
(58) Field of Search ..... 333/1.1, 24.2

(56) References Cited

U.S. PATENT DOCUMENTS 3,286,201 A * 11/1966 Roberts, Jr. ..... 333/1.1
3,621,477 A 11/1971 Bosma ..... 333/1.1
3,789,324 A * 1/1974 Iwase et al. ..... 333/1.1
4,309,666 A * 1/1982 Ito et al. ..... 333/1.1 X
5,945,887 A * 8/1999 Makino et al. ..... 333/1.1

FOREIGN PATENT DOCUMENTS

JP 07-283616 * 10/1995 ..... H01P/1/383
JP 10-327003 A * 12/1998 ..... H01P/1/383

* cited by examiner

*Primary Examiner*—Justin P. Bettendorf
(74) *Attorney, Agent, or Firm*—Keating & Bennett, LLP

(57) ABSTRACT

The invention discloses a nonreciprocal circuit device, a composite electronic component, and a communication apparatus, which can achieve miniaturization and cost reduction while having good characteristics. In the nonreciprocal circuit device, one of a plurality of matching capacitors is connected in series between one of a plurality of central conductors and a port of the central conductor. An end of each of the remaining matching capacitors is connected in parallel to each of the remaining central conductors, and the connecting parts are continued to ports of the remaining central conductors.

20 Claims, 5 Drawing Sheets

NONRECIPROCAL CIRCUIT DEVICE WITH SERIES AND PARALLEL MATCHING CAPACITORS AT DIFFERENT PORTS

BACKGROUND OF THE INVENTION

1. Field of the Invention

The present invention relates to nonreciprocal circuit devices, composite electronic components, and communication apparatuses incorporating the same, used in high frequency bands such as a microwave band.

2. Description of the Related Art

Recently, communication apparatuses such as cellular phones have adopted digital modulation systems of high band-utilization efficiencies. The modulation systems include a ¼-pi wavelength QPSK system, a CDMA system, and the like. In such communication apparatuses, linear power amplifiers are used as transmission power amplifiers. Additionally, in order to permit continuous long-hour talks over the telephones while reducing power consumption, the linear power amplifiers used in the above communication apparatuses have high efficiencies. However, the highly efficient linear power amplifiers have characteristics susceptible to changes in load impedance. In other words, the linear power amplifier can show its high efficiency only when the load impedance is fixed at a desired value. For example, when a load having great changes in input impedance level, such as an antenna, is directly connected to the linear power amplifier, the efficiency of the linear power amplifier decreases and the input/output linear characteristics are thereby deteriorated. As a result, since the power consumption in the amplifier increases, the length of time permitting communications is reduced. Furthermore, transmission waves tend to be distorted, thereby leading to the occurrence of interrupting waves between adjacent channels.

In order to solve the above problems, for example, as shown in FIG. 8, a lumped-constant isolator 30 is interposed between a linear power amplifier 20 and an antenna. The linear power amplifier 20 has a structure constituted by connecting an input matching circuit 21, a first-stage amplifying device 22, an interstage matching circuit 23, a second-stage amplifying device 24, and an output matching circuit 25. In the equivalent circuit of the isolator 30 shown in FIG. 9, three central conductors 31, 32, and 33 intersect with each other. A ferrite member 34 is disposed at the part where the three central conductors 31, 32, and 33 intersect with each other, and a DC magnetic field HDC is applied to the part. Matching capacitors C1, C2, and C3 are connected in parallel to the central conductors 31 to 33, respectively. A terminating resistor R is connected to a port P3 of the central conductor 33. Each of the central conductors 31 to 33 serves equivalently as an inductance L. In the isolator 30, the input impedance is stable regardless of changes in load impedance. That is, the isolator 30 has a function of stabilizing impedance matching by absorbing the reflection from a load. This function prevents reduction of the efficiency of the linear power amplifier 20 and deterioration of the input/output linearity. Typically, since the input/output characteristic impedance of the linear power amplifier 20 is designed to be 50 ohms, the input impedance in the isolator 30 is usually set to be 50 ohms, which is a standard value in a high frequency component.

Meanwhile, with miniaturization and weight reduction of cellular phones, the voltages of batteries used in the cellular phones have been set to be lower. The output voltages in the cellular phones are reduced to be in a range of approximately 3 to 4V. As a result, a rated operational voltage of the linear power amplifier is also set to be in the range of approximately 3 to 4V. A saturated electric power level of the linear power amplifier is determined by the operational voltage of the amplifier and the output impedance of an amplifying device such as a GaAs-FET or a silicon bipolar transistor. For example, in a linear power amplifier having a rated output power of approximately 1 W, the saturated electric power level is set to be approximately 2 W so as to obtain leeway.

However, as shown in FIG. 8, when the above low power-supply voltage is used, the output impedance of the output amplifying device 24 is in a range of approximately 3 to 10 ohms. This is much lower than the output impedance of the linear power amplifier 20, which is set to be 50 ohms as a normal value. As a result, in the above linear power amplifier 20, the output matching circuit 25 is connected to the output amplifying device 24 to convert the output impedance value of the linear power amplifier 20 into 50 ohms. However, when the low impedance level ranging from approximately 3 to 10 ohms is converted into 50 ohms, power loss due to loss in the output matching circuit 25 occurs and the width of a frequency band capable of matching is narrowed. Thus, these problems create factors that reduce the efficiency of the linear power amplifier 20 and the operational frequency bandwidth.

In addition, since a substrate on which the isolator is mounted, which is a circuit board, is formed into a thin plate, for example, there is a problem in that it is impossible to form a microstrip line at the characteristic impedance of 50 ohms with good width precision. Consequently, the isolator having the input/output impedance of 50 ohms has a problem in that matching failures occur.

SUMMARY OF THE INVENTION

Accordingly, it is an object of the present invention to provide a nonreciprocal circuit device, a composite electronic component, and a communication apparatus incorporating the same, in which there is no need to dispose an output matching circuit in a power amplifier while obtaining a good impedance matching with the power amplifier and/or a circuit board.

According to a first aspect of the present invention, there is provided a nonreciprocal circuit device including a plurality of central conductors arranged to intersect each other, a ferrite member disposed at the point of intersection of the central conductors and being adapted to receive a DC magnetic field, a plurality of ports corresponding to the plurality of central conductors, each of the ports having a matching capacitor connected to the corresponding central conductor in one of a series configuration and a parallel configuration.

With this arrangement, in the port having the matching capacitor connected in series to the corresponding central conductor, there is formed an LC series resonant circuit constituted of the inductance and the matching capacitor of the central conductor. The input/output impedance of this port can be set to be greatly lower than that of each of the ports having the matching capacitors connected in parallel to the corresponding central conductors. In other words, without adding another component used for performing impedance conversion, by connecting the matching capacitor in series to the central conductor and by changing the value of the matching capacitor, the input/output impedance can be set at an arbitrary low value.

In this case, the input/output impedance may be set to be in a range of 1 to 15 ohms according to the input/output impedance of an output-stage amplifying device of a power amplifier. With this arrangement, it is unnecessary to dispose a matching circuit used for performing impedance conversion, which is necessary in the conventional art. Accordingly, the power amplifier can be miniaturized while obtaining high efficiency and a wide frequency band.

Furthermore, with the use of the nonreciprocal circuit device in accordance with the present invention, the width of the microstrip line on a circuit board can be increased. As a result, the nonreciprocal circuit device can be mounted on the circuit board in a fixed and stable manner so that matching failures associated with the width of the microstrip line can be prevented.

In addition, the above nonreciprocal circuit device may further include a terminating resistor connected to one of the ports to form an isolator.

According to a second aspect of the present invention, there is provided a composite electronic component including the nonreciprocal circuit device and the power amplifier that are integrated with each other by connecting the nonreciprocal circuit device to an output section of the power amplifier. With this arrangement, a low-priced and compact composite electronic component having good characteristics can be obtained.

According to a third aspect of the present invention, there is provided a communication apparatus including one of the nonreciprocal circuit device and the composite electronic component described above. With this arrangement, similarly, a compact communication apparatus having good characteristics can be obtained at a low cost.

DESCRIPTION OF THE PREFERRED EMBODIMENTS

Figure 1:
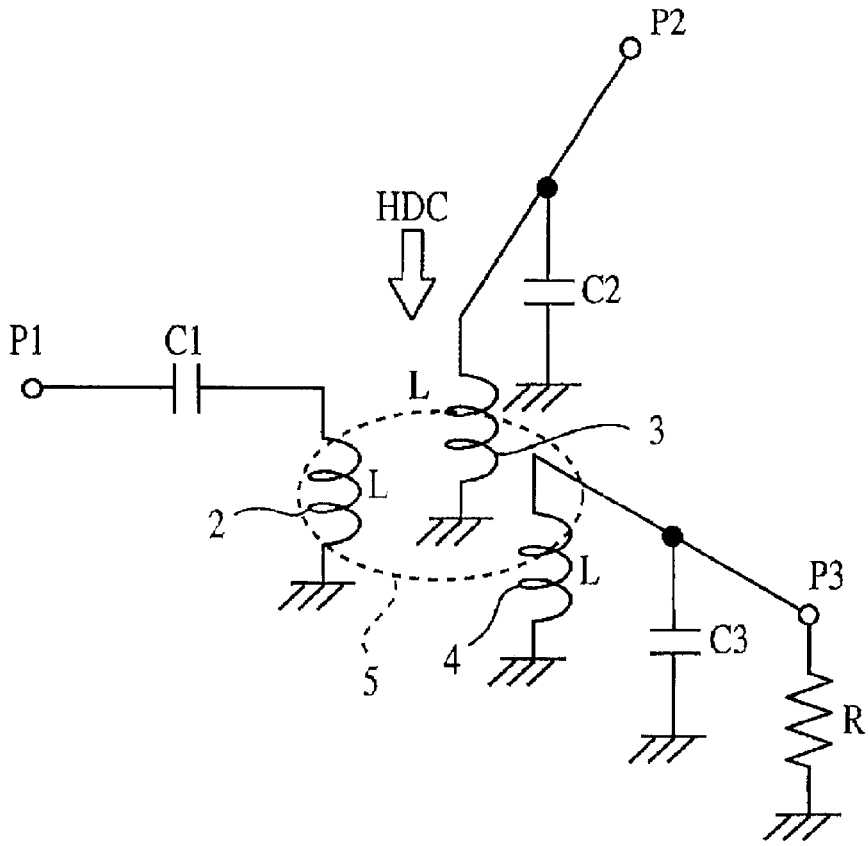
FIG. 1 is an equivalent circuit diagram of an isolator according to a first embodiment of the present invention.
Figure 2:
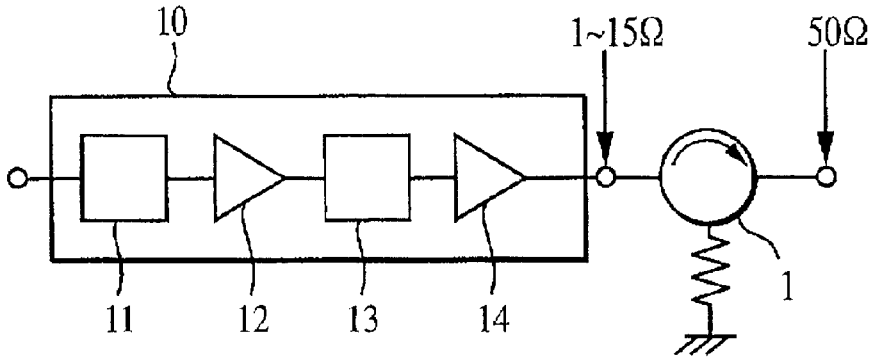
FIG. 2 is a block diagram of the transmission output section of a communication apparatus according to the first embodiment, which is constituted by the isolator shown in FIG. 1 and a power amplifier shown in FIG. 2.

Referring to FIGS. 1 and 2, a description will be given of the structures of an isolator according to a first embodiment of the present invention and the transmission output section of a communication apparatus incorporating the isolator. FIG. 1 is an equivalent circuit diagram of the isolator, and FIG. 2 is a block diagram of a transmission power amplifying section formed by using the isolator.

An isolator 1 of the first embodiment has a structure in which three central conductors 2, 3, and 4 intersect each other at specified angles, while being electrically isolated from each other, and a ferrite member 5 is disposed at the part where the three central conductors 2, 3, and 4 intersect each other, with a permanent magnet (not shown) used for applying a DC magnetic field HDC.

In addition, a matching capacitor C1 is connected in series between a central conductor 2 and a port P1, and matching capacitors C2 and C3 are connected in parallel to central conductors 3 and 4, respectively, and the connecting parts are continued to ports P2 and P3, respectively. The other end of each of the central conductors 2 to 4 is connected to a ground. In other words, an end of the matching capacitor C1 is connected to the central conductor 2, and the other end thereof is connected to the port P1. An end of each of the matching capacitors C2 and C3 is connected to the central conductors 3 and 4, and is also connected to the ports P2 and P3. Each of the other ends thereof is connected to a ground. In addition, a terminating resistor R is connected to the port P3 to transmit a signal sent from the port P1 to the port P2 and absorb a reflected wave entering from the port P2 by the terminating resistor R. Each of the central conductors 2 to 4 equivalently serves as an inductance L.

In the isolator 1 of the first embodiment, the matching capacitors C1 to C3 have substantially the equal size and capacitance value. The impedance of the port P1 is set to be in a range of 1 to 15 ohms, while the impedance of each of the ports P2 and P3 is set to be 50 ohms. In this arrangement, in the port P1, the matching capacitor C1 is connected in series to the central conductor 2. Thus, the input/output impedance of the port P1 can be greatly lower than that of each of the ports P2 and P3.

The isolator 1 is connected to the output section of a transmission power amplifier 10 of the communication apparatus, as shown in FIG. 2. The power amplifier 10 of the first embodiment includes an input matching circuit 11, a first-stage amplifying device 12, an interstage matching circuit 13, and a second-stage amplifying device 14. In this case, the power-supply voltage of the transmission power amplifier 10 is set to be in a range of 3 to 6 volts. The impedance of the second-stage amplifying device 14 is set to be in a range of 1 to 15 ohms. The port P1 of the isolator 1 is connected to the output section of the power amplifier 10, that is, the output section of the second-stage amplifying device 14 to form the transmission output section. The port P2 is connected to an antenna via a duplexer or the like, and the impedance matching of the port P2 is performed at 50 ohms as a standard value.

As described above, the arrangement of this embodiment is set such that the input impedance of the port P1 of the isolator 1 matches to the output impedance of the output stage amplifying device 14 of the power amplifier 10, which is connected to the port P1. With this arrangement, it is unnecessary to dispose an output matching circuit conventionally required for converting the low-impedance of an amplifying device into 50 ohms. Thus, the output power amplifier used in the first embodiment can be miniaturized. Furthermore, this arrangement can prevent an increase in insertion loss and the narrowing of a frequency band occurring when a matching circuit is disposed. As a result, in the isolator 1, insertion loss is reduced and the frequency band can be broadened.

Figure 3:
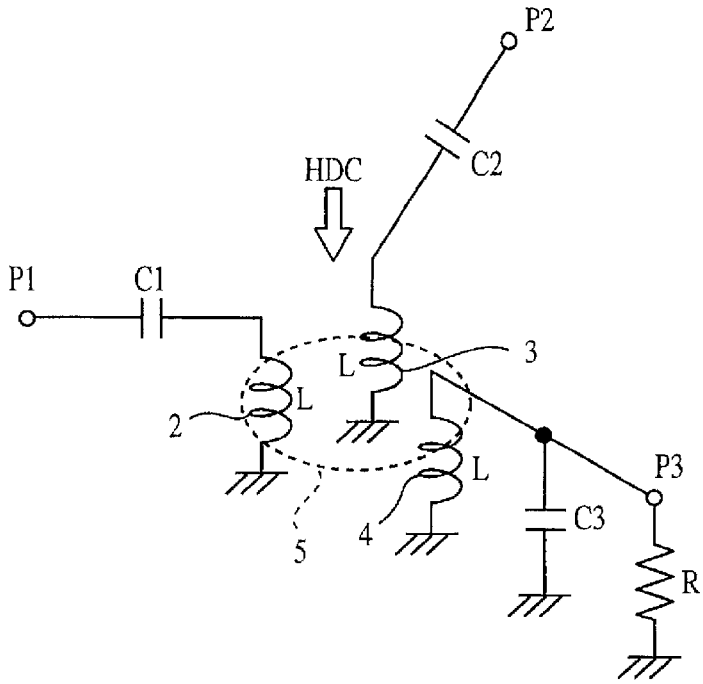
FIG. 3 is an equivalent circuit diagram of an isolator according to a second embodiment of the present invention.

In the isolator of the first embodiment, only one of the ports P1 to P3 is connected in series to the corresponding matching capacitor. However, as shown in FIG. 3, in both ports P1 and P2 of the input/output sides of an isolator according to another embodiment of the invention, matching capacitors C1 and C2 may be connected in series to central conductors 2 and 3. In this case, the input/output impedance of both ports P1 and P2 can be set to be in a low-impedance range of a few ohms to several tens of ohms. In other words, it is possible to achieve low impedance matching at both of the input and output sides of the isolator. With the use of the isolator shown in FIG. 3, when connected to a power amplifier, the same advantages as those in the first embodiment can be obtained. Thus, similarly, in the case of a load whose output side is set at a low impedance level, a good impedance matching can be achieved.

In addition, the present invention is not limited to the case of an isolator. As shown in each of FIGS. 4 and 5, the invention can be applied to a three-port type circulator. The circulator shown in each of FIGS. 4 and 5 has a structure in which there is no terminating resistor R connected to the third port P3 in the isolator shown in each of FIGS. 1 and 3. Similarly, in this case, the same advantages as those obtained in the first embodiment can be obtained.

Figure 6:
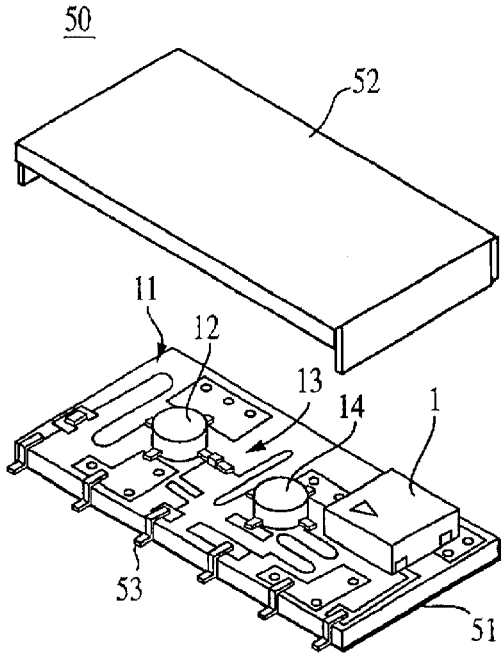
FIG. 6 is an exploded perspective view of a composite electronic component according to a fifth embodiment of the present invention.

FIG. 6 shows the structure of a composite electronic component according to another embodiment of the present invention. The composite electronic component in this embodiment is formed as a single unit by integrating the transmission output section shown in the block diagram of FIG. 2. In other words, a composite electronic component 50 used in this embodiment has a structure in which an input matching circuit 11, a first-stage amplifying device 12, an interstage matching circuit 13, a second-stage amplifying device 14, and an isolator 1 are mounted on a circuit board 51, and the devices 1 and 11 to 14 are connected by using a microstrip line. Furthermore, a shield case 52 is bonded to the circuit board 51, and terminals 53 used for inputting/outputting and grounding are connected to the electrode pads of input/output portions and grounds on the circuit board 51.

Figure 4:
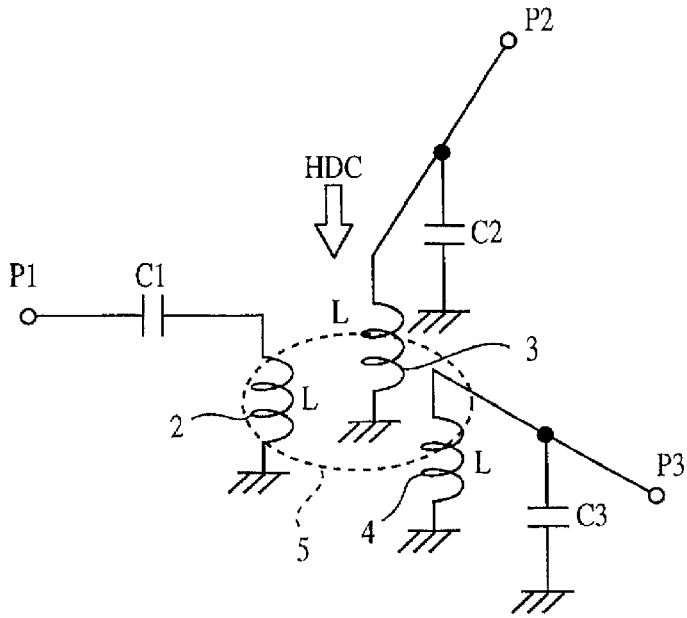
FIG. 4 is an equivalent circuit diagram of a circulator according to a third embodiment of the present invention.
Figure 5:
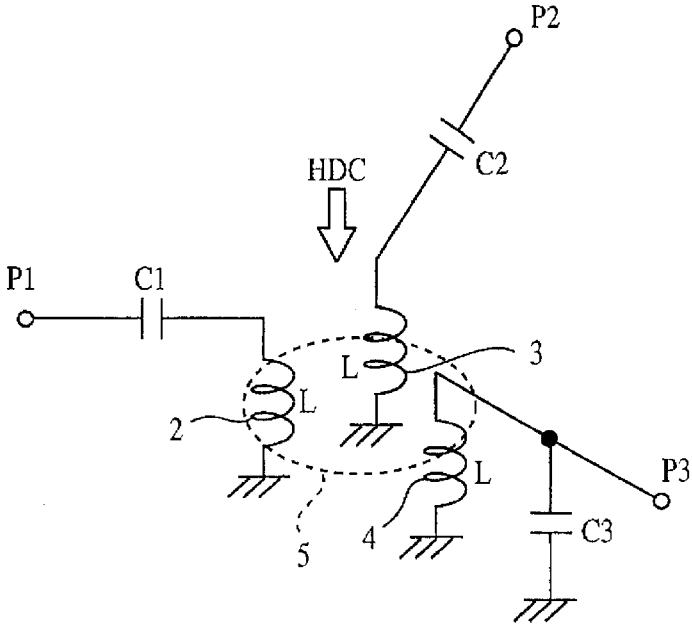
FIG. 5 is an equivalent circuit diagram of a circulator according to a fourth embodiment of the present invention.

In this embodiment, the composite electronic component 50 is miniaturized while having high efficiency and a wide frequency band. In this composite electronic component 50, a power amplifier 10 and the isolator 1 are integrated to form the single electronic component. As a result, the component can be easily incorporated (mounted) into a communication apparatus, and moreover, stable good characteristics can be obtained. The isolator, the circulator, and the power amplifier 10, which are shown in FIGS. 3, 4, and 5 may be integrated to form a composite electronic component.

Meanwhile, with the miniaturization of cellular phones, circuit boards used in the apparatuses are becoming thinner with the widths of microstrip lines becoming extremely narrower. For example, the line width at the characteristic impedance of 50 ohms obtained when the thickness of the circuit board is set to be 0.1 mm is 0.17 mm. In this way, when the line width becomes narrow, precision in the width of the microstrip line is reduced, thereby leading to occurrence of matching failures. In addition, it is necessary to set the widths of mounting pads used for soldering the devices to be larger than the width of a microstrip line. Thus, matching failures occur at the mounting pads. Furthermore, the narrowed line width causes an increase in transmission loss. In contrast, as in this embodiment, when the input/output impedance is set to be in the range of a few ohms to several tens of ohms, the width of the microstrip line can be broadened. Therefore, the problems of the matching failures and transmission loss mentioned above can be solved. Moreover, even though the widths of the mounting pads are broadened, matching failures can be prevented. As a result, when the isolator 1 is mounted, connecting failures due to positional deviations in the isolator 1 can be prevented, thereby leading to enhancement in mounting efficiency and strength. With these advantages, since productivity and ruggedization of the communication apparatus can be improved, a highly reliable communication apparatus can be produced at low cost.

Figure 7:
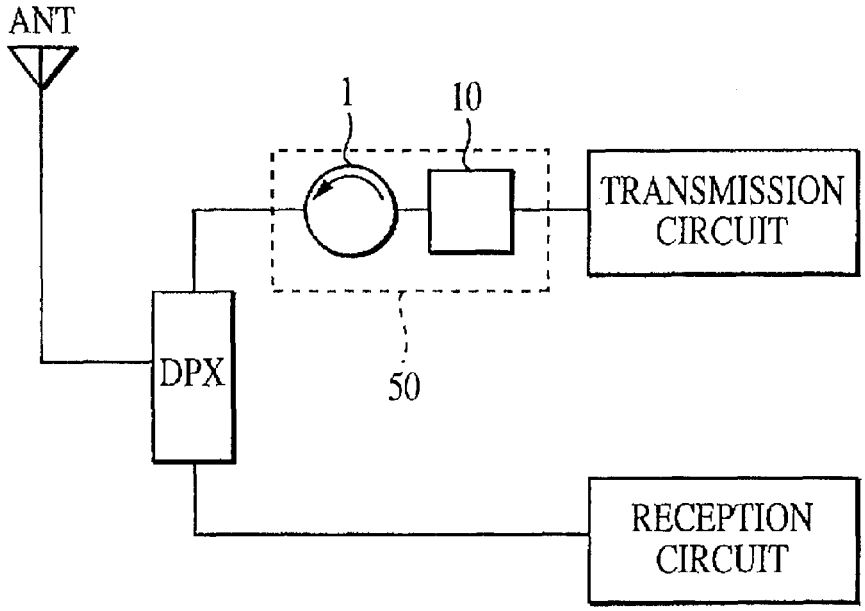
FIG. 7 is a block diagram of a communication apparatus according to a sixth embodiment of the present invention.
Figure 8:
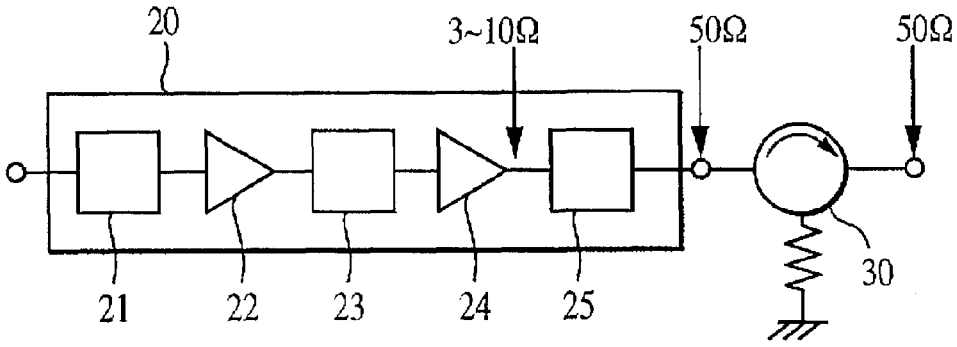
FIG. 8 PRIOR ART
FIG. 8 is a block diagram of the transmission output section of a communication apparatus constituted by a conventional isolator and a conventional power amplifier.
Figure 9:
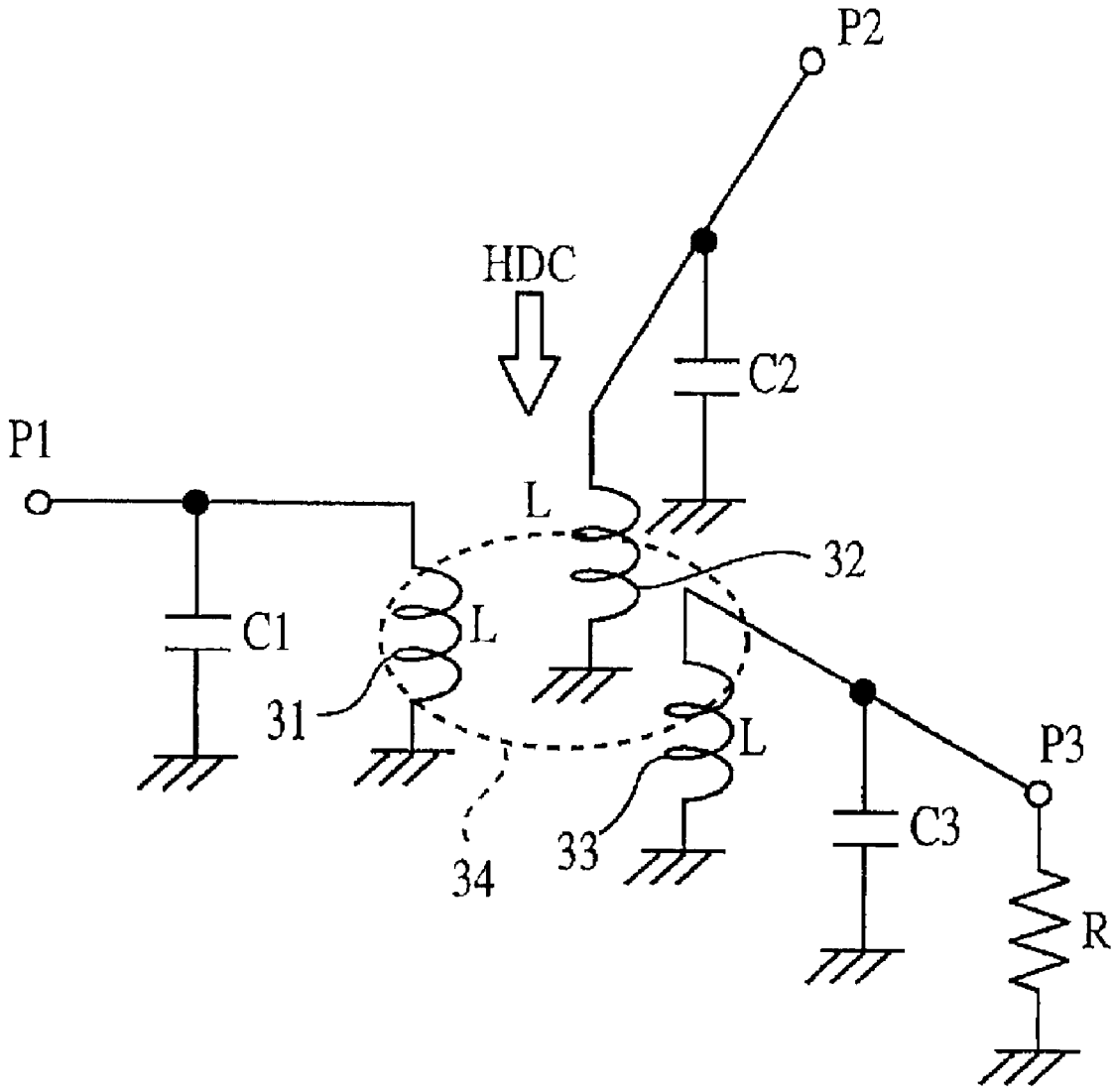
FIG. 9 PRIOR ART
FIG. 9 is an equivalent circuit diagram of the conventional isolator.

FIG. 7 shows the structure of a communication apparatus according to another embodiment of the present invention. In this communication apparatus, an antenna ANT is connected to the antenna end of a duplexer DPX including a transmission filter and a reception filter. A nonreciprocal circuit device 1 and a power amplifying circuit 10 are connected between the transmission filter and a transmission circuit, and a reception circuit is connected to the output end of the reception filter. A signal sent from the transmission circuit is transmitted from the antenna ANT via the power amplifying circuit 10, the nonreciprocal circuit device 1, and then the transmission filter of the duplexer DPX. In addition, a signal received by the antenna ANT is input to the reception circuit through the reception filter of the duplexer DPX.

In this case, as the above nonreciprocal circuit device 1, the nonreciprocal circuit device described in the first embodiment can be used. In addition, as a composite electronic component 50 in which the nonreciprocal circuit device 1 is integrated with the power amplifier 10, the composite electronic component shown in FIG. 6 can be used. By using one of the nonreciprocal circuit device and the composite electronic component in accordance with the present invention, a compact communication apparatus having good characteristics can be produced at a low cost.

As described above, in the nonreciprocal circuit device in accordance with the present invention, with the simple structure in which the matching capacitor is connected in series to the central conductor, the input/output impedance of the port can be set at a low level. Moreover, when connected to the power amplifier having a low output impedance level, there is no need to dispose an output matching circuit used for performing impedance conversion. Therefore, the power amplifier and the communication apparatus can be miniaturized while obtaining high efficiencies and broadened frequency bands.

Furthermore, since the width of the microstrip line disposed on the circuit board can be broadened, the nonreciprocal circuit device can be securely mounted in a stable manner, thereby matching failures associated with the line width can be prevented.

In addition, with the use of the nonreciprocal circuit device according to the present invention, a compact composite electronic component and a compact communication apparatus both having good characteristics can be produced at low costs.

While the preferred embodiments have been described above, variations and modifications may be made without departing from the spirit and scope of the present invention.

What is claimed is:

1. A nonreciprocal circuit device comprising:

a plurality of central conductors arranged to intersect each other at a point of intersection;

a ferrite member disposed at the point of intersection of the central conductors and being adapted to receive a DC magnetic field; and a plurality of ports corresponding to the plurality of central conductors, each of the ports having a matching capacitor connected to the corresponding central conductor;

wherein at least a first one of said matching capacitors is connected only in series with at least one of said central conductors and at least a second one of said matching capacitors is connected only in parallel with at least one of said central conductors; and said at least one of said central conductors having said at least one of said matching capacitors connected in series thereto has no capacitor connected in parallel thereto.

2. A nonreciprocal circuit device according to claim 1, wherein the input/output impedance of said one of said ports having the matching capacitor connected in series to the corresponding central conductor is set to be in a range of 1 to 15 ohms.

3. A nonreciprocal circuit device according to claim 2, further comprising a terminating resistor connected to one of the ports to form an isolator.

4. A nonreciprocal circuit device according to claim 1, further comprising a terminating resistor connected to a third one of the ports to form an isolator.

5. A nonreciprocal circuit device according to claim 1, further comprising a terminating resistor connected to one of the ports to form an isolator.

6. A composite electrode component comprising a power amplifier and a nonreciprocal circuit device;

the nonreciprocal circuit device having a plurality of central conductors arranged to intersect each other at a point of intersection;

a ferrite member disposed at the point of intersection of the central conductors and being adapted to receive a DC magnetic field; and a plurality of ports corresponding to the plurality of central conductors, each of the ports having a matching capacitor connected to the corresponding central conductor;

wherein the nonreciprocal circuit device is connected to an output section of the power amplifier and integrated therewith; and wherein at least a first one of said matching capacitors is connected only in series with at least one of said central conductors and at least a second one of said matching capacitors is connected only in parallel with at least one of said central conductors; and said at least one of said central conductors having said at least one of said matching capacitors connected in series thereto has no capacitor connected in parallel thereto.

7. A composite electronic component according to claim 6, wherein the input/output impedance of said one of said ports having the matching capacitor connected in series to the corresponding central conductor is set to be in a range of 1 to 15 ohms.

8. A composite electronic component according to claim 7, further comprising a terminating resistor connected to one of the ports to form an isolator.

9. A composite electronic component according to claim 6, further comprising a terminating resistor connected to one of the ports to form an isolator.

10. A composite electronic component according to claim 6, further comprising a terminating resistor connected to a third one of the ports to form an isolator.

11. A communication apparatus comprising at least one of a transmitting circuit and a receiving circuit, and a nonreciprocal circuit device connected thereto;

the nonreciprocal circuit device having a plurality of central conductors arranged to intersect each other at a point of intersection;

a ferrite member disposed at the point of intersection of the central conductors and being adapted to receive a DC magnetic field; and a plurality of ports corresponding to the plurality of central conductors, each of the ports having a matching capacitor connected to the corresponding central conductor;

wherein at least a first one of said matching capacitors is connected only in series with at least one of said central conductors and at least a second one of said matching capacitors is connected only in parallel with at least one of said central conductors; and said at least one of said central conductors having said at least one of said matching capacitors connected in series thereto has no capacitor connected in parallel thereto.

12. A communication apparatus according to claim 11, further comprising a terminating resistor connected to one of the ports to form an isolator.

13. A communication apparatus according to claim 11, wherein the input/output impedance of said one of said ports having the matching capacitor connected in series to the corresponding central conductor is set to be in a range of 1 to 15 ohms.

14. A communication apparatus according to claim 13, further comprising a terminating resistor connected to one of the ports to form an isolator.

15. A communication apparatus according to claim 11, further comprising a terminating resistor connected to a third one of the ports to form an isolator.

16. A communication apparatus comprising at least one of a transmitting circuit and a receiving circuit, and a composite electronic component connected thereto, the composite electronic component comprising a power amplifier and a nonreciprocal circuit device;

the nonreciprocal circuit device having a plurality of central conductors arranged to intersect each other at a point of intersection;

a ferrite member disposed at the point of intersection of the central conductors and being adapted to receive a DC magnetic field; and a plurality of ports corresponding to the plurality of central conductors, each of the ports having a matching capacitor connected to the corresponding central conductor;

the nonreciprocal circuit device being connected to an output section of the power amplifier and integrated therewith; and wherein at least a first one of said matching capacitors is connected only in series with at least one of said central conductors and at least a second one of said matching capacitors is connected only in parallel with at least one of said central conductors; and said at least one of said central conductors having said at least one of said matching capacitors connected in series thereto has no capacitor connected in parallel thereto.

17. A communication apparatus according to claim 16, wherein the input/output impedance of said one of said ports having the matching capacitor connected in series to the corresponding central conductor is set to be in a range of 1 to 15 ohms.

18. A communication apparatus according to claim 17, further comprising a terminating resistor connected to one of the ports to form an isolator.

19. A communication apparatus according to claim 16, further comprising a terminating resistor connected to one of the ports to form an isolator.

20. A communication apparatus according to claim 16, further comprising a terminating resistor connected to a third one of the ports to form an isolator.

* * * * *